United States Patent [19]

King et al.

[11] Patent Number: 4,471,049

[45] Date of Patent: Sep. 11, 1984

[54] DYE IMAGE-GENERATING PHOTOGRAPHIC ELEMENTS

[75] Inventors: Roy King, Bushey; David T. Southby, Harrow, both of England

[73] Assignee: Eastman Kodak Company, Rochester, N.Y.

[21] Appl. No.: 525,081

[22] Filed: Aug. 22, 1983

[30] Foreign Application Priority Data

Apr. 12, 1983 [GB] United Kingdom ..... 8309845

[51] Int. Cl.³ ..... G03C 1/46

[52] U.S. Cl. ..... 430/504; 430/372; 430/393; 430/505; 430/507; 430/510; 430/551

[58] Field of Search ..... 430/505, 507, 510, 524, 430/525, 551, 372, 393, 504

[56] References Cited

U.S. PATENT DOCUMENTS

| | | | |
|---|---|---|---|
| 2,336,327 | 12/1943 | Weissberger et al. | 430/507 |
| 2,839,405 | 6/1958 | Jones | 430/608 |
| 3,206,310 | 9/1965 | Herz | 430/606 |
| 3,392,021 | 7/1968 | McGuckin | 430/507 |
| 3,945,829 | 3/1976 | Zorn et al. | 430/507 |
| 4,028,112 | 6/1977 | Sato et al. | 430/515 |

FOREIGN PATENT DOCUMENTS

WO80/01962 3/1980 PCT Int'l Appl. .

*Primary Examiner*—J. Travis Brown

*Attorney, Agent, or Firm*—Carl O. Thomas

[57] ABSTRACT

Photographic elements intended to generate dye images containing at least one colloidal silver layer and at least one hydroquinone antistain agent have been observed to suffer from random fog spotting, which can be reduced by incorporating a catalyst for the decomposition of hydrogen peroxide. The imagewise exposed elements when photographically processed and bleached of silver produce viewable dye images.

20 Claims, No Drawings

DYE IMAGE-GENERATING PHOTOGRAPHIC ELEMENTS

FIELD OF THE INVENTION

This invention relates to dye image-generating photographic elements containing at least one colloidal silver layer and at least one hydroquinone antistain agent.

BACKGROUND OF THE INVENTION

Photographic elements which produce viewable images consisting essentially of dye, hereinafter also referred to as dye image-generating photographic elements, and which contain both colloidal silver and hydroquinone antistain agent are well known in the photographic art. Such photographic elements can be illustrated by silver halide photographic elements containing a colloidal silver layer. Yellow colloidal silver, also referred to as Carey Lea silver or CLS, is employed in silver halide photographic elements to protect minus blue—i.e., green and/or red sensitized silver halide emulsion layers—from exposure to blue light. Grey colloidal silver is sometimes employed to reduce halation. Colloidal silver is also sometimes used in interlayers to control interimage effects. Hydroquinone antistain agents are commonly used in and/or between silver halide emulsion layers to reduce migration of oxidized developing agent between layers of the photographic element.

To provide a specific illustration, in photographic elements intended to generate multicolor dye images it is conventional practice to coat on a support three separate superimposed dye image-generating layer units, each including at least one silver halide emulsion layer. Within one dye image-generating layer unit is located a blue sensitive silver halide emulsion, usually in combination with at least one compound capable of generating a yellow dye image, typically a yellow dye-forming coupler. Within another dye image-generating layer unit is located a blue sensitive silver halide emulsion which is spectrally sensitized to the green portion of the spectrum, usually also containing at least one compound capable of generating a magenta dye image, typically a magenta dye-forming coupler. Within a third dye image-generating layer unit is located a blue sensitive silver halide emulsion which is spectrally sensitized to the red portion of the spectrum, usually also containing a compound capable of generating a cyan dye image, typically a cyan dye-forming coupler. In each layer unit the image dye generating compound can be located in the emulsion layer or in an adjacent, usually contiguous layer. To protect the green and red sensitized silver halide emulsions from exposure to blue light it is common practice to coat a yellow colloidal silver layer to lie between the dye image-generating layer units containing these emulsions and the source of exposing radiation. Image dye is typically generated as a direct or inverse function of imagewise exposure of silver halide during photographic development. Reaction of developing agent with the silver halide grains during development produces oxidized developing agent which then reacts with the compound capable of generating the dye image, typically "coupling" with the dye-forming coupler to form a dye.

If in this circumstance oxidized developing agent migrates to an adjacent dye image-generating layer unit before reacting with an image dye generating compound, a false record of exposure is produced, sometimes referred to as dye stain. To avoid this, it is common practice to incorporate in an interlayer between silver halide emulsion layers of adjacent color-generating layer units and/or directly in the emulsion and/or other layers of the color-generating layer units a hydroquinone suitably ballasted to restrict its mobility, such hydroquinones being commonly referred to as antistain agents. Silver produced during development is an unwanted by-product which is removed together with colloidal silver by bleaching after the dye image is formed. Thus the photographic elements produce multicolor images which consist essentially of image dye.

A problem that has been observed occasionally in color photographic elements is the formation of random fog spots.

SUMMARY OF THE INVENTION

In one aspect this invention is directed to a photographic element capable of producing a viewable image consisting essentially of a dye comprising a support and, located on the support, at least one silver halide emulsion layer, at least one layer containing colloidal silver, and at least one hydroquinone antistain agent, the improvement comprising a colloidal catalyst for the decomposition of hydrogen peroxide located to reduce contact of said colloidal silver with hydrogen peroxide.

In another aspect this invention is directed to a method of producing a dye image comprising photographically processing an imagewise exposed photographic element as described above to produce a dye image and bleaching silver from the photographic element.

The present invention is based on discoveries of the origin and means for reduction of the objectionable random spots occasionally observed in photographic elements containing both a hydroquinone antistain agent and colloidal silver. It has been observed (1) that these random spots can be caused by the action of peroxide on colloidal silver and (2) that the hydroquinone antistain agent is the predominant source of the peroxide which results in the formation of the spots. As a consequence of these discoveries, it has been recognized that the spots can be eliminated by incorporating in the photographic elements colloidal particles of a catalyst for the decomposition of hydrogen peroxide.

PRIOR USE OF PEROXIDE DECOMPOSITION CATALYSTS

PCT published application, Publication No. WO 80/01962, discloses that fully processed photographic silver images, typically black-and-white photographic prints, can be protected from attack by peroxide by treating them, or incorporating in them, colloidal particles of a catalyst for the decomposition of hydrogen peroxide. In this case the protection sought is obtained by having the decomposition catalyst in the photographic element containing the silver image—i.e., after photographic processing has been completed. This can be achieved by an after treatment—i.e., by treating the otherwise fully processed silver image bearing element, or by incorporating the catalyst in the photographic element as it is manufactured and choosing a processing regime that allows the catalyst to remain afterward. Since the purpose is to protect the silver image remaining after processing, the teaching of incorporating a peroxide decomposition catalyst is clearly inapplicable to photographic elements which produce images consisting essentially of dye, as is typical of conventional multicolor silver halide photographic elements.

DESCRIPTION OF PREFERRED EMBODIMENTS

The present invention is directed to the improvement of conventional silver halide photographic elements intended to form images consisting essentially of dye. Specifically, this invention is directed to reducing the deleterious effects of hydrogen peroxide on unprocessed silver halide photographic elements intended to form dye images. More specifically, the present invention is directed to reducing random spotting of dye image producing silver halide photographic elements containing at least one colloidal silver layer and at least one hydroquinone antistain agent.

It has been observed that these photographic elements can be protected against random fog spotting by the incorporation of a colloidal catalyst for the decomposition of hydrogen peroxide. Colloidal particles of gold, Group VIII noble metals (e.g., platinum and palladium), and manganese dioxide, for example, are known to be effective hydrogen peroxide decomposition catalysts in silver halide photographic elements. Manganese dioxide is generally preferred.

The catalyst can be incorporated in the photographic element in any amount sufficient to effect peroxide decomposition. For example, concentrations of manganese dioxide in the photographic elements ranging from 1 to 1000 $mg/m^2$, preferably from about 10 to 500 $mg/m^2$, are specifically contemplated.

The purpose of employing the catalyst in colloidal form is to maximize its catalytic decomposition activity. The colloidal catalyst particles can range up to about 10 microns in average effective diameter and range down to the smallest conveniently obtained sizes, such as down to about 1 nm. Generally the smaller particle sizes are preferred, with average effective particle diameters preferably being below 100 nm, most preferably 50 nm, and optimally no larger than 15 nm.

The catalyst particles can be located in the photographic element at any effective location. That is, the catalyst particles can be positioned within the photographic element at any location permitting reduction of hydrogen peroxide contact with colloidal silver to be achieved. The catalyst particles can be located within any one or combination of the silver halide emulsion layers, image dye generating compound containing layers, antistain agent containing layers, or colloidal silver containing layers as well as other layers, such as interlayers. Since random fog spotting is believed to be produced by hydrogen peroxide generated by the antistain agent contacting the colloidal silver, it is preferred that the catalyst particles be located in either the antistain agent containing layers or the colloidal silver containing layers or in layers separating these layers. It is specifically preferred to locate the catalyst particles in the colloidal silver containing layers or adjacent layers, particularly those interposed between the antistain agent and the colloidal silver.

Since the function of the catalyst particles is to protect the photographic elements against hydrogen peroxide generated prior to photographic processing, it is unnecessary that the catalyst particles remain in the processed dye image containing photographic elements. The catalyst particles in most instances can be conveniently removed during photographic processing, although this is not required. For example, manganese dioxide catalyst particles are readily removed when the photographic element is contacted with a conventional acid fixer containing sulfite ions.

The hydroquinone antistain agents can be chosen from a variety of conventional ballasted hyroquinones incorporated in photographic elements to scavenge oxidized developing agent. The antistain agents can be located in the silver halide emulsion layers, in the dye image generating compound containing layers, and/or in separate layers, such as interlayers. Exemplary of contemplated hydroquinone antistain agents are those disclosed in Weissberger et al U.S. Pat. No. 2,336,327, Vittum et al U.S. Pat. No. 2,360,290, Jelley et al U.S. Pat. No. 2,403,721, and Loria et al U.S. Pat. No. 2,728,659, here incorporated by reference to show the antistain agents themselves as well as their location, concentration, and manner of incorporation. Particularly preferred antistain agents and their use are disclosed by Knechel et al U.S. Pat. No. 3,700,453. The antistain agents typically include at least one and more typically two ballasting ring substituents, typically occupying the 2 and 5 or 6 ring positions. Preferred ballasting groups are alkyl groups containing from about 8 to 20 carbon atoms. Both normal and branched chain alkyl groups can be employed. Mono-secondary and di-secondary dodecylhydroquinones, particularly when employed in combination, are highly preferred antistain agents.

The photographic elements contain at least one silver halide emulsion layer. Any of the conventional radiation-sensitive silver halide emulsions heretofore recognized to be useful in photography can be employed. Either negative-working or direct-positive silver halide emulsions can be employed. Illustrative useful emulsions are disclosed in *Research Disclosure,* Vol. 176, December 1978, Item 17643, Paragraph I, here incorporated by reference. The use of high aspect ratio tabular grain silver halide emulsions, as disclosed in *Research Disclosure,* Vol. 225, January 1983, Item 22534, is specifically contemplated. Both *Research Disclosure* and its predecessor, *Product Licensing Index,* are publications of Industrial Opportunities Ltd., Homewell, Havant Hampshire, P09 1 EF, U.K.

The layers of the photographic elements can be coated on any conventional photographic support. Typical photographic supports include polymer film, wood fiber—e.g., paper, metallic sheet and foil, glass and ceramic supporting elements provided with one or more subbing layers to enhance the adhesive, antistatic, dimensional, abrasive, hardness, frictional, antihalation, and/or other properties of the support surfaces. Typical useful supports are further disclosed in *Research Disclosure,* Item 17643, cited above, Paragraph XVII, here incoporated by reference.

The photographic elements can, of course, contain other conventional features known in the art, which can be illustrated by reference to *Research Disclosure,* Item 17643, cited above. For example, the silver halide emulsions can be chemically sensitized, as described in Paragraph III; spectrally sensitized as described in Paragraph IV; contain brighteners, as described in Paragraph V; contain antifoggants and stabilizers, as described in Paragraph VI; absorbing and scattering materials, as described in Paragraph VIII, the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasticizers and lubricants, as described in Paragraph XII; and the layers, particularly the layers coated farthest from the support, can contain matting agents, as described in Paragraph XVI. This exemplary listing of addenda and features is not intended to restrict or imply the absence of other conventional photographic features compatible with the practice of the invention.

Although the invention is directed to those photographic elements which are intended to produce viewable dye images as opposed to viewable silver images, no image dye generating compound need necessarily be incorporated in the photographic element as initially prepared, since processing techniques for introducing image dye generating compounds after imagewise exposure and during processing are well known in the art. However, to simplify processing it is common practice to incorporate image dye generating compounds in photographic elements prior to processing, and such photographic elements are specifically contemplated in the practice of this invention. The photographic elements can form dye images through the selective destruction, formation, or physical removal of incorporated image dye generating compounds.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

The photographic elements can produce dye images through the selective formation of dyes, such as by reacting (coupling) a color-developing agent (e.g., a primary aromatic amine) in its oxidized form with a dye-forming coupler. The dye-forming couplers can be incorporated in the photographic elements, as illustrated by Schneider et al, Die Chemie, Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930.

In one form the dye-forming couplers are chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550.

The photographic elements can incorporate alkali-soluble ballasted couplers, as illustrated by Froelich et al and Tong, cited above. The photographic elements can be adapted to form non-diffusible image dyes using dye-forming couplers in developers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can produce dye images through the selective removal of dyes. Negative or positive dye images can be produced by the immobilization or mobilization of incorporated color-providing substances as a function of exposure and development, as illustrated by U.K. Pat. Nos. 1,456,413, 1,479,739, 1,475,265 and 1,471,752, Friedman U.S. Pat. No. 2,543,691, Whitmore U.S. Pat. No. 3,227,552, Bloom et al U.S. Pat. No. 3,443,940, Morse U.S. Pat. No. 3,549,364, Cook U.S. Pat. No. 3,620,730, Danhauser U.S. Pat. No. 3,730,718, Staples U.S. Pat. No. 3,923,510, Oishi et al U.S. Pat. No. 4,052,214 and Fleckenstein et al U.S. Pat. No. 4,076,529.

In one illustrative form the present invention can be applied to a photographic element such as disclosed by Marchant et al U.S. Pat. No. 3,620,747. Such photographic elements are capable of wide exposure latitude and are capable of producing high contrast when exposed to faint images and low contrast when exposed to bright images. In the photographic elements a colloidal silver antihalation layer is coated on a film support. Over the antihalation layer is coated a first panchromatically sensitized photographic silver halide emulsion layer containing (1) a nondiffusible photographic coupler which forms image dye and (2) a development inhibitor-releasing photographic coupler. A second panchromatically sensitized photographic silver halide emulsion layer is coated over the first emulsion layer and contains a nondiffusible photographic coupler which form image dye, the second emulsion layer having a faster effective photographic speed than the first emulsion layer. Between the emulsion layers is provided an interlayer to prevent dye contamination resulting from oxidized developing agent wandering between the emulsion layers. The interlayer can contain a hydroquinone antistain agent for this purpose. In a preferred form the photographic element is modified to incorporate a hydrogen peroxide decomposition catalyst in the antihalation layer or at any of the other useful locations previously described.

The invention can be readily applied to conventional silver halide photographic elements intended to form multicolor dye images. Such photographic elements can take a variety of forms. The following illustrate varied layer order arrangements:

| Layer Order Arrangment I |
|---|
| OC |
| B |
| IL + CLS + ASA + PDC |
| G |
| IL + ASA |
| R |
| S |

-continued

| Layer Order Arrangement II |
|---|
| OC |
| B + Y |
| IL + CLS + ASA + PDC |
| FG + M |
| IL + ASA |
| FR + C |
| IL + ASA |
| SG + M |
| IL + ASA |
| SR + C |
| S |

| Layer Order Arrangement III |
|---|
| OC |
| B |
| IL + ASA + YF |
| G |
| IL + ASA |
| R |
| AHU + PDC |
| S |

| Layer Order Arrangement IV |
|---|
| OC |
| TFG |
| IL + ASA + PDC |
| TFR |
| IL + ASA + PDC |
| FB |
| IL + ASA + PDC |
| SB |
| IL + ASA + PDC + CLS |
| SG |
| IL + ASA + PDC |
| SR |
| S |

where
AHU designates a colloidal silver antihalation undercoated layer;
ASA designates a hydroquinone antistain agent;
B, G, and R designate blue, green, and red recording dye image generating layer units, respectively;
CLS designates Carey Lea silver--i.e., yellow colloidal silver;
F or S appearing before the dye image generating layer unit B, G, or R indicates that the dye image generating layer unit is faster or slower, respectively, in photographic speed than at least one other dye image generating layer unit which records light exposure in the same third of the spectrum in the same Layer Order Arrangement;
IL designates an interlayer, a transparent hydrophilic colloid;
OC designates an overcoat, typically a hydrophilic colloid layer optionally containing ultraviolet absorbing agent, plasticizer and lubricants, and matting agents;
PDC designates a hydrogen peroxide decomposition catalyst;
S indicates a photographic support;
T appearing before the dye image generating layer unit B, G, or R indicates that the emulsion layer or layers contain a high aspect ratio tabular grain silver halide emulsion;
Y, M, and C designate yellow, magenta, and cyan dye image generating compounds, respectively; and
YF designates a yellow filter material, which can be yellow colloidal silver or an alternative conventional yellow filter material, such as a yellow dye.

Layer Order Arrangement I illustrates the application of the invention to a simple multicolor photographic element of a type which incorporates color image generating compounds during processing to produce a dye image. Although the hydrogen peroxide decomposition catalyst is shown only in the Carey Lea silver containing interlayer, it can be located also in one or all of the remaining layers of the photographic element, if desired.

Layer Order Arrangement II illustrates the application of the present invention to a multicolor photographic element in which both faster and slower red and green recording dye image generating layer units are present. The positioning of the faster green and red dye image generating layer units above the slower green and red dye image generating layer units increases the required number of interlayers containing hydroquinone antistain agent. Thus, the opportunity for generation of hydrogen peroxide is substantially increased with this layer order arrangement, and the photographic element therefore should benefit to a much larger extent by the incorporation of a hydrogen peroxide decomposition catalyst.

Layer Order Arrangement III illustrates a variation on Layer Order Arrangement I in which a colloidal silver antihalation layer underlies the dye image generating layer units. The yellow filter material can, but need not, be yellow colloidal silver. Though not specifically illustrated, it can be appreciated that Layer Order Arrangement II can be analogously modified.

Layer Order Arrangement IV illustrates that the high aspect ratio tabular grain emulsions intended to record green or red exposures need not be protected from blue light exposure by an overlying yellow filter layer. However, in this exemplary layer order arrangement the slower green and red dye image generating layer units do not contain high aspect ratio tabular grain emulsions and are protected against blue light exposure by the Carey Lea silver in the overlying interlayer. Each of the interlayers between the dye image generating layer units still contain hydroquinone antistain agent. Hydrogen peroxide decomposition catalyst is shown incorporated in each of the interlayers. It could be restricted to just the interlayer containing Carey Lea silver. Additionally or alternatively, it could be located in the faster blue and slower green dye image generating layer units or in any of the various other arrangements previously described.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wave-like radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23.

The photographic elements can be processed to produce a viewable dye image and remove developed silver by conventional methods of processing color photographic elements. Techniques compatible with forming dye images and removing developed silver described in *Research Disclosure,* Item 17643, cited above, Paragraph XIX A and B are contemplated. The photographic elements can be processed to form dye images which correspond to or are reversals of the silver halide rendered selectively developable by imagewise exposure.

Multicolor reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* August 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS No. 2,005,091.

Multicolor dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

The following Example is included for a better understanding of the invention.

EXAMPLE

A series of photographic color negative film multilayer coatings was made in which colloidal manganese dioxide was incorporated into the Carey-Lea silver (CLS) yellow filter layer or antihalation undercoat (AHU), comprising grey colloidal silver, layer of the film. Two levels of oxidized developer scavenger isododecylhydroquinone (IDH) were used for each laydown of manganese dioxide. A description of the coatings is given in Tables I and II. Control coatings containing no manganese dioxide were also made.

TABLE I

| Manganese dioxide added to AHU layer | | |
|---|---|---|
| Coating No. | $MnO^2$ (mg/m$^2$ of Mn) | IDH (mg/m$^2$) |
| 1 | 25 | 161. |
| 2 | 25 | 484. |
| 3 | 50 | 484. |
| 4 | 50 | 161. |

TABLE II

| Manganese dioxide added to CLS layer | | |
|---|---|---|
| Coating No. | $MnO^2$ (mg/m$^2$ of Mn) | IDH (mg/m$^2$) |
| 5 | 10 | 484. |
| 6 | 10 | 161. |

Samples of each film were subjected to simulated aging tests and then processed through a standard C41 process as described in the *British Journal of Photography Annual* 1977 p. 204, without exposure, and viewed.

The control coating containing 0.484 g/m$^2$ IDH showed a high incidence of fog spots. This was significantly reduced in coatings 1 through 4 in which manganese dioxide was incorporated into the AHU. The higher level of manganese was particularly effective in reducing by a factor of over one hundred the fog spot count for a given area of film. Coatings 5 and 6 showed that manganese dioxide was also very effective in reducing fog spot formation when incorporated into the CLS layer. At the levels employed manganese dioxide had no deleterious effects on the sensitometry of these coatings.

The invention has been described in detail with particular reference to preferred embodiments thereof, but it will be understood that variations and modifications can be effected within the spirit and scope of the invention.

We claim:

1. A photographic element capable of producing a viewable image consisting essentially of dye comprising
a support and, located on said support,
at least one silver halide emulsion layer,
at least one layer containing colloidal silver, and
at least one hydroquinone antistain agent,
the improvement comprising a colloidal catalyst for the decomposition of hydrogen peroxide located to reduce contact of said colloidal silver with hydrogen peroxide.

2. A photographic element according to claim 1 which contains, associated with said silver halide emulsion layer, an image dye generating compound.

3. A photographic element according to claim 1 in which said colloidal silver layer is a yellow colloidal silver filter layer or a grey colloidal silver antihalation layer.

4. A photographic element according to claim 1 in which said catalyst for the decomposition of hydrogen peroxide is present in contact with or adjacent said hydroquinone antistain agent.

5. A photographic element according to claim 1 in which said catalyst for the decomposition of hydrogen peroxide is present in or adjacent said colloidal silver layer.

6. A photographic element according to claim 1 in which said catalyst for the decomposition of hydrogen peroxide is colloidal manganese dioxide.

7. A photographic element according to claim 6 in which said colloidal manganese dioxide is present in a concentration of at least 1 mg/m$^2$.

8. A photographic element according to claim 7 in which said colloidal manganese dioxide is present in a concentration of less than 1000 mg/m$^2$.

9. A photographic element according to claim 6 in which said hydroquinone antistain agent is hydroquinone containing at least one ring alkyl substituent having from 8 to 20 carbon atoms.

10. A photographic element according to claim 9 in which said alkyl substituent is a secondary alkyl.

11. In a photographic element capable of producing a multicolor dye image comprised of
a support and, located thereon,
a blue recording yellow dye image generating layer unit containing at least one blue sensitive silver halide emulsion layer,
a green recording magenta dye image generating layer unit containing at least one green sensitized silver halide emulsion layer,
a red recording cyan dye image generating layer unit containing at least one red sensitized silver halide emulsion layer,
hydroquinone antistain agent located to reduce migration of oxidized developing agent between said dye image generating layer units,
a colloidal silver layer located to receive exposing radiation,
the improvement comprising colloidal manganese dioxide incorporated in a fog reducing concentration in or adjacent said colloidal silver layer.

12. A photographic element according to claim 11 wherein said image dye generating layer units each contain an image dye forming coupler.

13. A photographic element according to claim 11 wherein said colloidal manganese dioxide is present in a concentration of from 10 to 500 mg/m$^2$.

14. A photographic element according to claim 11 wherein said hydroquinone antistain agent is hydroquinone which is mono- or di-secondary alkyl substituted.

15. A photographic element according to claim 12 wherein said antistain agent is an isododecylhydroquinone.

16. A photographic element according to claim 11 wherein said colloidal silver layer is an antihalation undercoat located between said image dye generating layer units and said support.

17. A photographic element according to claim 11 wherein said colloidal silver layer is a yellow filter layer located to reduce blue light reaching said green and red recording image dye generating layer units upon imagewise exposure.

18. A method of producing a dye image comprising
photographically processing an imagewise exposed photographic element according to claim 1 to produce a dye image and
bleaching silver from the photographic element.

19. A method according to claim 18, wherein said colloidal particles of hydrogen peroxide decomposition catalyst are additionally removed.

20. A method of producing a multicolor dye image comprising
photographically processing an imagewise exposed photographic element according to claim 11 to produce a multicolor dye image,
bleaching silver from the photographic element, and removing manganese dioxide.

* * * * *